United States Patent [19]

Kelly

[11] 4,265,191

[45] May 5, 1981

[54] SEWING MACHINE WITH TRIMMER DRIVE MECHANISM

[75] Inventor: Edward A. Kelly, Wethersfield, Conn.

[73] Assignee: The Merrow Machine Company, Hartford, Conn.

[21] Appl. No.: 46,400

[22] Filed: Jun. 6, 1979

[51] Int. Cl.[2] ..... D05B 65/02

[52] U.S. Cl. ..... 112/288

[58] Field of Search ..... 112/287, 288, 285, 291, 112/292, 293, 122, 129, 130; 74/84 R, 22 A, 25

[56] References Cited

U.S. PATENT DOCUMENTS

| | | | |
|---|---|---|---|
| 2,827,869 | 3/1958 | Nering | 112/311 |
| 3,557,730 | 1/1971 | Armstead | 112/287 |
| 3,981,257 | 9/1976 | Kelly | 112/256 |
| 4,138,957 | 2/1979 | Blessing et al. | 112/287 |

*Primary Examiner*—H. Hampton Hunter

*Attorney, Agent, or Firm*—Beveridge, DeGrandi, Kline & Lunsford

[57] ABSTRACT

A sewing machine has a movable feed member for feeding articles to a stitch-applying station, and a trimmer for cutting chains of stitches which dangle from articles on the outfeed side of the stitch-applying station. The feed member and trimmer are driven from the same drive shaft. The trimmer drive includes a swinging crank which is connected to a rotary cam by a one-way clutch, one-way clutches which support the rotary cam and permit it to rotate only in the direction it is driven by the crank, and a rocker arm which has one end driven by the cam and another end drivingly connected to the trimmer.

10 Claims, 5 Drawing Figures

FIG. 1
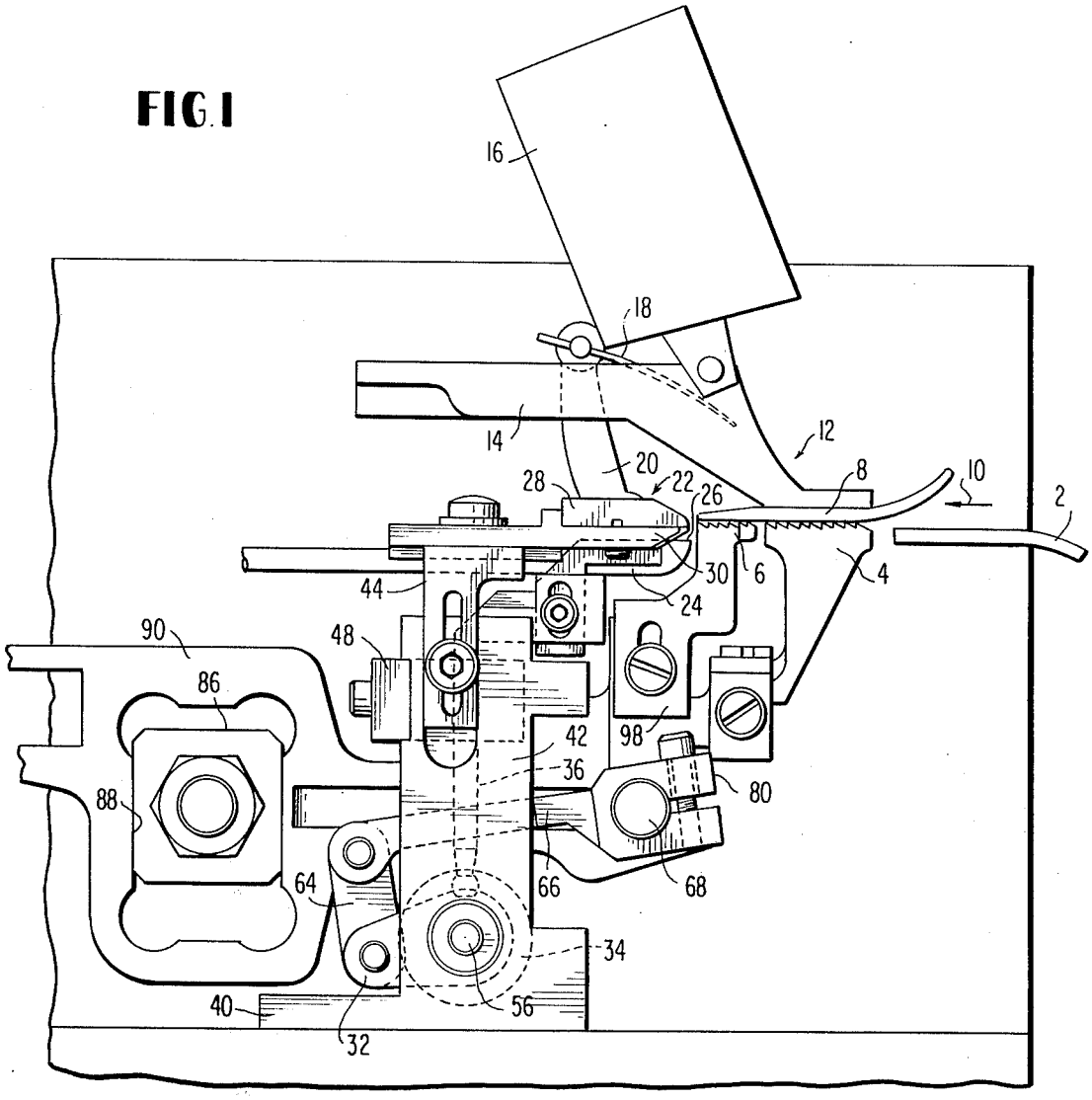
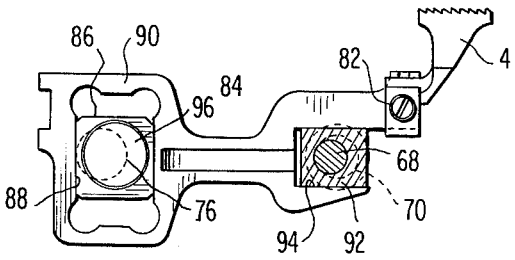
FIG. 4
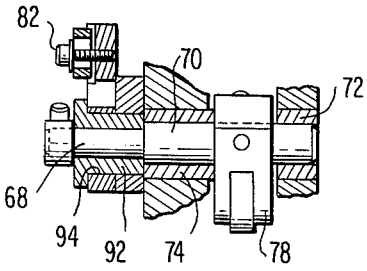
FIG. 5

SEWING MACHINE WITH TRIMMER DRIVE MECHANISM

BACKGROUND OF THE INVENTION

This invention relates to improvements in sewing machines provided with trimmer mechanisms which cut dangling chains of stitches from the leading or trailing edges of sewn articles.

A machine of this general nature is disclosed by U.S. Pat. No. 3,557,730 which issued Jan. 22, 1971 naming George B. Armstead, Jr., as inventor and The Merrow Machine Company, Hartford, Connecticut, as assignee. In this prior machine, the trimmer mechanism was actuated by a separate drive motor which was considered desirable because the speed requirements of such a motor were substantially less than those of the high speed drive motor of the sewing machine.

Since the development of the machine shown in U.S. Pat. No. 3,557,730, a need has been recognized for an integrated machine in which a separate trimmer drive motor is not required. This invention provides such a machine in a relatively uncomplicated manner which avoids the necessity of speed reduction gearing between the main drive shaft of the machine and the trimmer mechanism.

SUMMARY OF THE INVENTION

The present invention is applicable to sewing machines wherein a feed drive mechanism drives a feed member which engages and moves articles in a feed direction through a sewing station. On the outfeed side of the sewing station, a trimmer is provided for cutting dangling chains of stitches from articles sewn by the machine. The trimmer is driven by a trimmer drive mechanism which produces relative transverse movement between a pair of blades disposed transversely to the feed direction. The trimmer drive mechanism is driven by the feed drive mechanism, as is the case with prior art sewing machines. The invention pertains primarily to a trimmer driven by a mechanism which includes a rotary member supported by a one way clutch which permits its movement in one rotary direction. The rotary member is driven by a second one way clutch which, when engaged, drives the rotary member in the rotary direction. Means are provided for rotationally oscillating the second one way clutch to rotate the member; and, the rotary member is operatively connected to one of the trimmer blades to drive the trimmer in response to rotation of the rotary member.

The rotary member preferably is a cam engaged with a cam follower in the operative connection to the trimmer blade. Preferably, the invention is practiced by connecting the trimmer drive mechanism to the mechanism which raises the sewing machine feed dogs into contact with a fabric being fed through the machine. This feed raising mechanism may include a rotationally oscillated driven shaft. Also it is preferred that a rocker arm be provided to connect the rotary cam to one of the trimmer blades, the rocker arm having one end engaged with the rotary cam and the other end engaged with the trimmer blade. The invention also presents additional features which will become apparent from an understanding of the following description and the accompanying drawings.

THE DRAWINGS

FIG. 1 is a simplified elevational view showing an overedge sewing machine constructed according to the invention.

FIG. 4 is an elevational view showing the principal elements of the feed drive mechanism for one feed dog.

FIG. 5 is a sectional view through the axis of the feed raising shaft.

DESCRIPTION OF A PREFERRED EMBODIMENT

Figure 2:
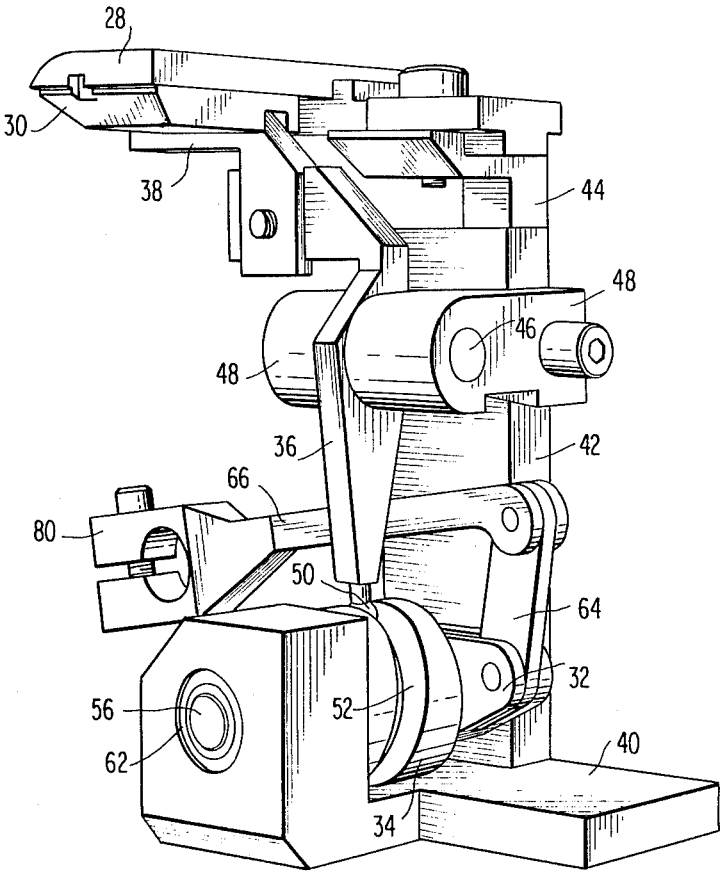
FIG. 2 is a perspective view of a preferred trimmer drive mechanism when removed from a sewing machine.

As shown in FIG. 1, the sewing machine has a work plate 2 which supports infeeding articles, and feed dogs 4 and 6 which coact with a presser foot 8 to feed articles in the direction of arrow 10 to and through a stitch-applying station 12. The presser foot 8 is supported by an arm 14 and is biased downwardly against the needle plate by a loading and release assembly generally designated 16. A needle 18 on arm 20 applies a series of connected stitches to the article at the stitch-applying station 12. This general structure is well known in the art and is disclosed, for example, in U.S. Pat. No. 2,827,869 which is incorporated herein by reference.

A thread trimmer 22 is located on the outfeed side of the stitch-applying station to cut chains of stitches which dangle from the leading and trailing ends of articles which have been sewn. A suction duct connected to a vacuum source by tube 24 has an inlet opening 26 adjacent to the trimmer. The suction duct draw the dangling chains of stitches into the trimmer assembly 22 to cut the thread. The trimmer includes blades 28 and 30 which have spaced teeth projecting toward the stitch-applying station 12. These blades 28 and 30 are disposed transversely to the article feed direction of arrow 10. The upper surface of blade 28 is generally at the same level as the work plate 2 so as not to impede the passage of articles through the machine. The lower blade 30 is oscillated in a transverse linear path to provide a shearing action between the teeth of the trimmer blades, thereby severing any threads which are advanced into the trimmer. The structure and use of such a suction and trimmer arrangement is disclosed in U.S. Pat. No. 3,557,730 which is incorporated herein by reference.

The present invention involves an improved mechanism for operating the trimmer 22, and a novel cooperation between the trimmer assembly and the article feeding mechanism.

Figure 3:
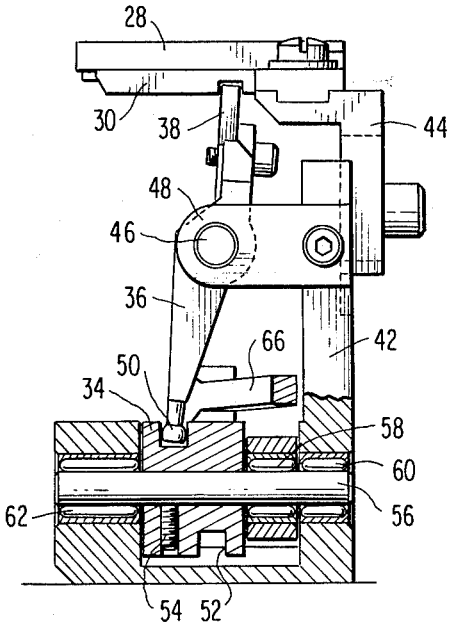
FIG. 3 is a rear elevational view of the mechanism of FIG. 2, partially in section to illustrate the location of the one way clutches.

The trimmer drive mechanism is shown in FIGS. 1, 2 and 3. It includes a crank 32, rotary cam 34 which is rotated by the crank, and a rocker arm 36 which is given oscillatory pivotal movement by the cam. The upper end of the rocker arm 36 has an adjustable extension 38 which engages and drives the lower trimmer blade 30 by projecting into a keyway on the underside thereof.

The trimmer and its drive mechanism are supported on a frame which has a base 40 and a vertical pedestal 42. A bracket 44 attached to the pedestal 42 supports the upper trimmer blade 28 which, in turn, supports the movable lower trimmer blade for transverse linear movement. Details of this structure are not important to the present invention but are shown in the previously-mentioned U.S. Pat. No. 3,557,730.

The midsection of rocker arm 36 is pivotally supported on a pin 46 which projects through and is supported by the members 48 affixed to pedestal 42. The lower end of the rocker arm 36 includes a spherical cam follower 50 which rides in the continuous peripheral slot 52 of cam 32.

The cam 32 is rotationally and axially fastened by set screw 54 to a shaft 56 as shown in FIG. 3. Cam rotation is produced by oscillatory swinging motion of the crank 32 which is connected to the shaft 56 by a one-way clutch 58. The shaft 56 is supported at its opposite ends by one-way clutches 60 and 62 which are oriented similarly to clutch 58 so that all of the clutches permit shaft and cam rotation in the same direction and prevent shaft and cam rotation in the opposite direction. If, for example, the shaft-supporting clutches 60 and 62 in FIG. 2 permit only clockwise shaft rotation, the shaft-driving clutch 58 also engages in a clockwise direction. With the clutches so disposed, clockwise movement of the crank 32 will drive the shaft 56 and cam 34 in a clockwise direction; however, when the crank 32 moves counterclockwise, the clutches 60 and 62 prevent counterclockwise shaft rotation, and the clutch 58 releases to permit the crank 32 to return to its starting position preparatory to the subsequent clockwise driving movement.

As shown in FIG. 1, the crank 32 is oscillated by a link 64, an arm 66 and the end portion 68 of the feed-raising shaft. This shaft, shown best at 70 in FIG. 5 is supported on stationary bearings 72 and 74, and has an integral eccentric end portion 68. It is driven in a rotational oscillating manner by a connecting rod (not shown) which has one end driven by an eccentric on a driven main input shaft 76 (FIG. 4) and its other end pivotally connected to the end of a lever 78 on the feed raising shaft 70. This structure, while not pertinent to the present invention, is shown in FIG. 7 of U.S. Pat. No. 3,981,257, the entirety of which is incorporated herein by reference.

The arm 66 has a split ring clamp 80 at one end which engages the eccentric end portion 68 of shaft 70, whereby the movement of the shaft produces vertical movement of the arm 66. The link 64 is pivotally connected to the outer ends of arm 66 and crank 32 so that vertical movement of the arm will cause the crank 32 to move about 60° in an oscillatory manner. As previously described, this will produce rotary movement of cam 34, pivotal movement of the rocker arm 36 and oscillating linear motion of the lower trimmer blade 30 to cut dangling threads on articles which pass through the machine.

The shaft 70 also drives the feed dogs 4 and 6, in the manner described in U.S. Pat. No. 3,981,257. These dogs move in a vertical elliptical path, primarily driven by the structure shown in FIGS. 4 and 5. The dog 4 is connected by screw 82 to the forward end of a carrier 84 which itself moves in the same elliptical path as the feed dog. The horizontal component of this elliptical movement is delivered to the carrier by a block 86 which is slidable in a vertical slot 88 in scotch yoke 90 of the carrier 84; whereas the vertical component of this elliptical movement is delivered to the carrier by a feed raising block 92 which slides in a horizontal slot 94 of the carrier 84. Block 86 is driven by a bushing 96 which is rotatable within the bore of block 86 and is eccentrically mounted for rotation on the main input shaft, the outline of which is shown by broken line 76 in FIG. 4. The feed raising block 92 has a bore which rotatably receives the eccentric end portion 68 of the rotationally oscillating feed raising shaft 70. The rotary movement of the main input shaft 76, coordinated with the movement of the feed raising shaft, causes the carrier 84 and feed dog 4 to traverse a vertical elliptical path. In the lower segment of this elliptical path, the dog is retracted below an article being sewn and it moves oppositely from the feed direction. The feed raising shaft 70, block 92 and carrier 84 raise the dog from this retracted position to a raised position where it contacts an article being fed. The horizontal feeding movement is imparted to the dog by the bushing 96, block 86 and carrier 84. The other feed dog 6 is supported on a carrier 98 which is similarly supported and driven.

Persons familiar with the field of this invention will recognize that it provides an improved trimmer drive for sewing machines which have such trimmers, the improvements being due both to the nature of the drive mechanism and to the concept of driving the trimmer and feed means from the same driven mechanical component. Skilled persons will also realize that the invention may take a wide variety of forms other than the preferred embodiment disclosed herein. For example, it has been suggested by an associate that the rotary cam 34, crank 32 and clutches 58, 60 and 62 be moved upwardly to a position proximate to the trimmer blades 28 and 30. With this arrangement, a pin affixed to the lower trimmer blade 30 will project directly into the cam slot 52. This eliminates the rocker arm 36 and avoids adjustment problems associated with it. Accordingly, it is emphasized that the invention, rather than being limited to the disclosed apparatus, embraces a wide variety of modified or improved structures which fall within the spirit of the following claims.

I claim:

1. A sewing machine, comprising, a feed member for engaging and moving articles in a feed direction through a sewing station where stitches are applied to the article, a feed drive mechanism for driving the feed member, a trimmer on the outfeed side of the sewing station for cutting dangling chains of stitches from articles sewn by the machine, said trimmer including a pair of blades, a trimmer drive mechanism for producing relative movement between the trimmer blades, the improvement wherein said trimmer drive mechanism includes a rotary member, means for operatively connecting the rotary member to one of the trimmer blades to drive the trimmer blade in response to rotation of the rotary member, a first one-way clutch supporting said rotary member for movement in one rotary direction, a second one-way clutch for driving said rotary member in said rotary direction, and means for rotationally oscillating said second one-way clutch to rotate said rotary member and move said one of said trimmer blades.

2. The sewing machine of claim 1 wherein the rotary member is a cam, and the means for operatively connecting the rotary member to one of the blades includes a cam follower engaged with said cam.

3. The sewing machine of claim 1 including a driven shaft connected to and driving the feed drive mechanism, said means for rotationally oscillating the second one-way clutch including means connecting said second one-way clutch to said driven shaft.

4. The sewing machine of claim 3 wherein the rotary member is a cam, and the means for operatively connecting the rotary member to one of the blades includes a cam follower engaged with said cam.

5. The sewing machine of claim 1 wherein the means for operatively connecting the rotary member to one of the trimmer blades is a rocker arm having one end engaged with the rotary member and another end engaged with the trimmer blade.

6. The sewing machine of claim 5 wherein the rotary member is a cam, and the one end of the rocker arm is provided with a cam follower engaged with said cam.

7. The sewing machine of claim 1 wherein said feed drive mechanism includes feed raising means for moving the feed member from a retracted position to a raised position where it contacts an article being fed.

8. The sewing machine of claim 7 including a driven shaft connected to and driving the feed drive mechanism, said means for rotationally oscillating the second one-way clutch including means connecting said second one-way clutch to said driven shaft.

9. The sewing machine of claim 8 wherein said driven shaft is rotationally oscillated.

10. The sewing machine of claim 9 wherein the rotary member is a cam, and the means for operatively connecting the rotary member to one of the blades including a cam follower engaged with said cam.

* * * * *